US012256776B2

(12) United States Patent
Hupkes

(10) Patent No.: US 12,256,776 B2
(45) Date of Patent: Mar. 25, 2025

(54) AEROSOL GENERATION DEVICE HAVING CLOSURE WITH RIGID BIASING ELEMENT

(71) Applicant: JT International S.A., Geneva (CH)

(72) Inventor: Ernst Hupkes, Kampen (NL)

(73) Assignee: JT International S.A. (CH)

( * ) Notice: Subject to any disclaimer, the term of this patent is extended or adjusted under 35 U.S.C. 154(b) by 589 days.

(21) Appl. No.: 17/625,548

(22) PCT Filed: Aug. 7, 2020

(86) PCT No.: PCT/EP2020/072304

§ 371 (c)(1),
(2) Date: Jan. 7, 2022

(87) PCT Pub. No.: WO2021/023878

PCT Pub. Date: Feb. 11, 2021

(65) Prior Publication Data

US 2022/0287362 A1 Sep. 15, 2022

(30) Foreign Application Priority Data

Aug. 8, 2019 (EP) ..... 19190885

(51) Int. Cl.
*A24F 40/40* (2020.01)
*A24F 40/20* (2020.01)

(52) U.S. Cl.
CPC ..... *A24F 40/40* (2020.01); *A24F 40/20* (2020.01)

(58) Field of Classification Search
None
See application file for complete search history.

(56) References Cited

U.S. PATENT DOCUMENTS

2015/0114410 A1 4/2015 Doster
2015/0164138 A1 6/2015 Liu
(Continued)

FOREIGN PATENT DOCUMENTS

CN 203446532 U 2/2014
CN 206687163 U 12/2017
(Continued)

OTHER PUBLICATIONS

Search Report dated Jan. 31, 2024 from the Office Action for Chinese Application No. 202080054517.2, 3 pages.
(Continued)

*Primary Examiner* — Philip Y Louie
*Assistant Examiner* — Virginia R Bieger
(74) *Attorney, Agent, or Firm* — Lerner David LLP

(57) ABSTRACT

An aerosol generation device has a body, a closure, a resilient element and a rigid element. The body has an aperture through which an aerosol substrate is receivable into the aerosol generation device. The closure is moveable relative to the aperture between a closed position in which the closure covers the aperture and an open position in which the aperture is substantially unobstructed by the closure. The rigid element has a first end arranged to cooperate with the closure and a second end pivotally coupled to the body such that the rigid element rotates relative to the body as the closure moves between the closed position and the open position. The resilient element is mounted on the rigid element and is arranged to provide a resilient force that biases the closure towards at least one of the closed position and the open position.

18 Claims, 7 Drawing Sheets

(56) References Cited

U.S. PATENT DOCUMENTS

| | | | | |
|---|---|---|---|---|
| 2017/0027221 | A1 | 2/2017 | Liu | |
| 2017/0208865 | A1 | 7/2017 | Schennum et al. | |
| 2017/0222468 | A1 | 8/2017 | Schennum et al. | |
| 2020/0008472 | A1 | 1/2020 | Long et al. | |
| 2020/0375251 | A1* | 12/2020 | Borges | A24F 40/53 |
| 2022/0142247 | A1 | 5/2022 | Mason et al. | |
| 2022/0142250 | A1 | 5/2022 | Bouchuiguir et al. | |

FOREIGN PATENT DOCUMENTS

| | | | |
|---|---|---|---|
| CN | 107582257 | A | 1/2018 |
| CN | 207383538 | U | 5/2018 |
| CN | 108523245 | A | 9/2018 |
| CN | 109965360 | A | 7/2019 |
| CN | 113727617 | A | 11/2021 |
| CN | 113766843 | A | 12/2021 |
| EP | 3003073 | B1 | 3/2018 |
| GB | 2585620 | A | 1/2021 |
| JP | H02034103 | Y2 | 9/1990 |
| JP | 2003516196 | A | 5/2003 |
| JP | 2016511724 | A | 4/2016 |
| JP | 2019518430 | A | 7/2019 |
| WO | 0141845 | A1 | 6/2001 |
| WO | 2015/139358 | A1 | 9/2015 |
| WO | 2017194769 | A1 | 11/2017 |
| WO | 2019074799 | A1 | 4/2019 |
| WO | 2019115113 | A1 | 6/2019 |

OTHER PUBLICATIONS

International Search Report for Application No. PCT/EP2020/072304 mailed Oct. 16, 2020, pp. 1-4.

* cited by examiner

AEROSOL GENERATION DEVICE HAVING CLOSURE WITH RIGID BIASING ELEMENT

CROSS-REFERENCE TO RELATED APPLICATIONS

The present application is a national phase entry under 35 U.S.C. § 371 of International Application No. PCT/EP2020/072304, filed Aug. 7, 2020, published in English, which claims priority to European Application No. 19190885.4 filed Aug. 8, 2019, the disclosures of which are incorporated herein by reference.

FIELD OF THE DISCLOSURE

The present disclosure relates to an aerosol generation device having a closure with a rigid biasing element. The closure may be arranged so as to be moveable between a closed position and an open position. The disclosure is particularly, but not exclusively, applicable to a portable aerosol generation device, which may be self-contained and low temperature. Such devices may heat, rather than burn, tobacco or other suitable materials by conduction, convection, and/or radiation, to generate an aerosol for inhalation.

BACKGROUND TO THE DISCLOSURE

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or agitate an aerosol substrate to produce an aerosol and/or vapour for inhalation, as opposed to burning tobacco as in conventional tobacco products.

One type of reduced-risk or modified-risk device is a heated substrate aerosol generation device, or heat-not-burn device. Devices of this type generate an aerosol and/or vapour by heating a solid aerosol substrate, typically moist leaf tobacco, to a temperature typically in the range 150° C. to 300° C. Heating an aerosol substrate, but not combusting or burning it, releases an aerosol and/or vapour that comprises the components sought by the user but not the toxic and carcinogenic by-products of combustion and burning. Furthermore, the aerosol and vapour produced by heating the aerosol substrate, e.g. tobacco, does not typically comprise the burnt or bitter taste resulting from combustion and burning that can be unpleasant for the user. This means that the aerosol substrate does not require sugars or other additives that are typically added to the tobacco of conventional tobacco products to make the smoke and/or vapour more palatable for the user.

Existing aerosol generation devices can be awkward to use and the required components can lack user-friendliness. For example, it is helpful to provide a cover that can protect the region of the device where the aerosol substrate is provided for use; this cover is moved frequently by the user of the device and so a cover that lacks user-friendliness is undesirable.

EP 3003073 B1 describes a container for an elongate electronic nicotine delivery system or other flavoured vapour delivery system. The container has a lid that is pivotally attached to a body so that it covers first and ancillary openings in the insert in a closed position.

CN 206687163 U describes a low-temperature smoking article, comprising a cover body that is movably mounted on a casing and configured to be movable between a first position and a second position. A trigger switch is provided for activating or conducting the power supply circuit.

In both of the prior art publications, the lid is simple and no mechanism for effectively controlling movement of the lid is disclosed.

SUMMARY OF THE DISCLOSURE

Aspects of the disclosure are set out in the accompanying claims.

According to a first aspect of the disclosure, there is provided an aerosol generation device comprising:

a body having an aperture through which an aerosol substrate is receivable into the aerosol generation device;

a closure moveable relative to the aperture between a closed position in which the closure covers the aperture and an open position in which the aperture is substantially unobstructed by the closure;

a rigid element having a first end arranged to cooperate with the closure and a second end pivotally coupled to the body such that the rigid element rotates relative to the body as the closure moves between the closed position and the open position; and a resilient element mounted on the rigid element, the resilient element being arranged to provide a resilient force that biases the closure towards at least one of the closed position and the open position.

The use of a rigid element to mount a resilient element provides support to the resilient element and increases the robustness of the closure.

Preferably, the resilient element is arranged to be displaced with the closure in a first direction as the closure moves between the closed position and the open position, and wherein at least a first end of the resilient element is arranged to move in a second direction as the closure moves between the closed position and the open position, the second direction being transverse to the first direction.

Preferably, the second direction is parallel to the length of the rigid element between the first end and the second end.

Preferably, the second direction extends towards the body from the closure.

Optionally, the rigid element has a traveller arranged to move in a direction extending between the first end and the second end of the rigid element as the closure moves between the closed position and the open position, the traveller cooperating with the resilient element to transfer the resilient force between the resilient element and the closure.

Optionally, the resilient element deforms in order to provide the resilient force, the direction of the deformation being guided by the rigid element.

Optionally, the direction of the deformation is parallel to the length of the rigid element between the first end and the second end of the rigid element.

Optionally, the resilient element is a helical compression spring.

Optionally, the rigid element comprises a shaft on which the helical compression spring is located.

Optionally, the aerosol generation device comprises a guide, wherein a carriage is arranged to move along the guide as the closure moves between the open position and the closed position, the carriage being arranged to interact with the closure. Preferably, the guide provides an arc-shaped or linear guiding path.

Optionally, the resilient element is arranged to provide the resilient force so as to bias the carriage towards a side of the guide. Preferably, the resilient element is arranged to bias the carriage towards a side of the guide away from the body.

Optionally, the closure is stable in each of the closed position and the open position.

Optionally, the resilient element is arranged so as to bias the closure towards the closed position from a first range of positions between the closed position and the open position and to bias the closure towards the open position from a second range of positions between the closed position and the open position, the first range of positions of the closure being closer to the closed position than the second range of positions and the second range of positions of the closure being closer to the open position than the first range of positions.

Optionally, the closure is further moveable from the open position to an activation position at which the aerosol generation device is operable to initiate an activation signal.

Optionally, the resilient element is arranged to provide the resilient force so as also to bias the closure away from the activation position.

Optionally, the resilient element is arranged so as to deform in at least one of: a direction out of a plane defined by the aperture; a direction aligned with an axis of the aperture; and/or a direction aligned with the direction in which the aerosol substrate is receivable when the closure is moved between the closed position and the open position.

Each of the aspects above may comprise any one or more features mentioned in respect of the other aspects above.

The disclosure extends to any novel aspects or features described and/or illustrated herein. Further features of the disclosure are characterised by the other independent and dependent claims.

Use of the words "apparatus", "device", "processor", "module" and so on are intended to be general rather than specific. Whilst these features of the disclosure may be implemented using an individual component, such as a computer or a central processing unit (CPU), they can equally well be implemented using other suitable components or a combination of components. For example, they could be implemented using a hard-wired circuit or circuits, e.g. an integrated circuit, and using embedded software.

It should be noted that the term "comprising" as used in this document means "consisting at least in part of". So, when interpreting statements in this document that include the term "comprising", features other than that or those prefaced by the term may also be present. Related terms such as "comprise" and "comprises" are to be interpreted in the same manner. As used herein, "(s)" following a noun means the plural and/or singular forms of the noun.

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

Preferred embodiments are now described, by way of example only, with reference to the accompanying drawings.

BRIEF DESCRIPTION OF THE DRAWINGS

FIG. 2(*b*) is an assembled view of the closure of the first embodiment of the aerosol generation device.

FIG. 3(*b*) is a schematic cross-sectional view from the side of the first embodiment of the closure, where the closure is in an intermediary position.

FIG. 3(*c*) is a schematic cross-sectional view from the side of the first embodiment of the closure, where the closure is in an open position.

DETAILED DESCRIPTION OF THE EMBODIMENTS

First Embodiment

Figure 1:
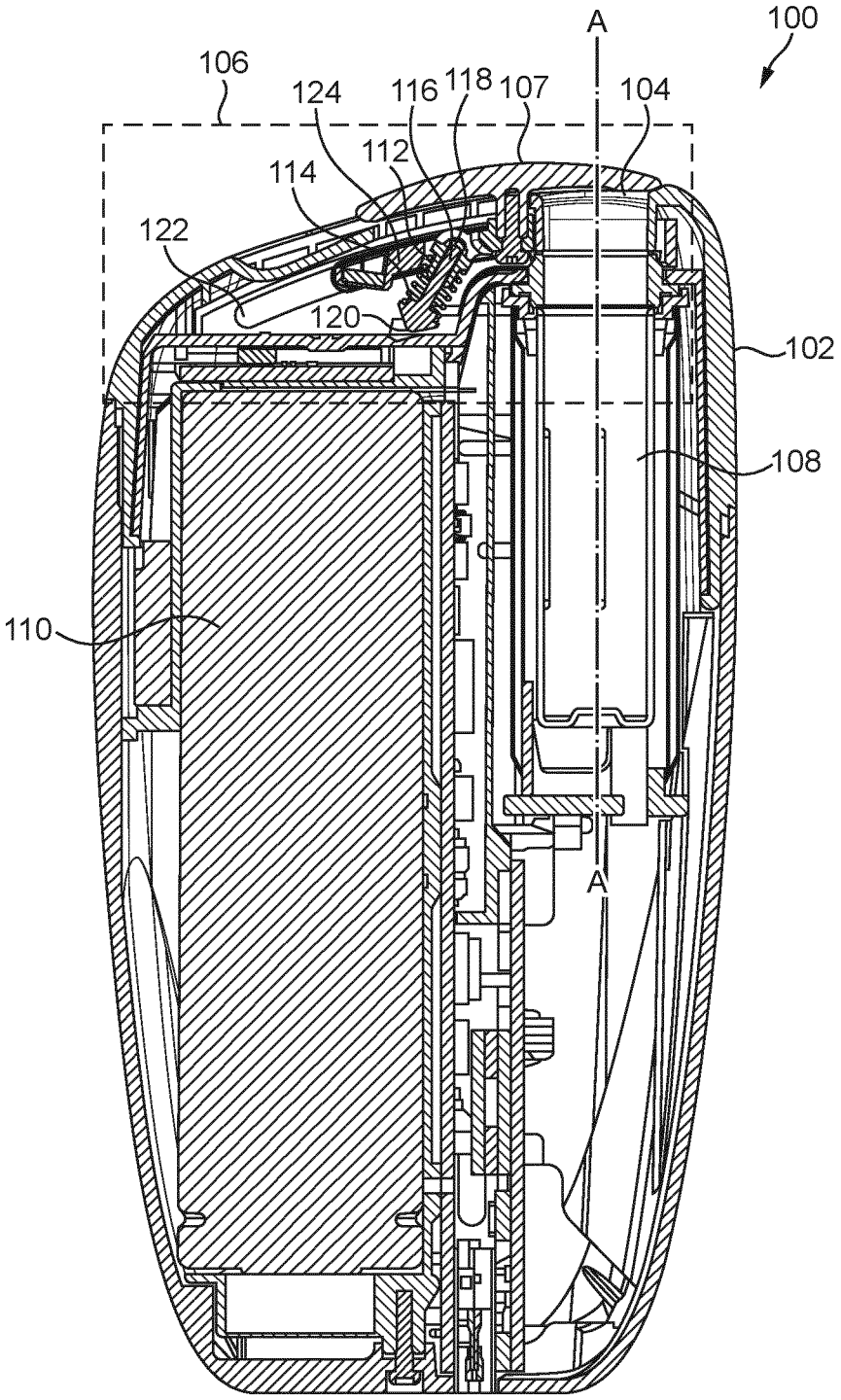
FIG. 1 is a schematic cross-sectional view of a first embodiment of an aerosol generation device.

Referring to FIG. 1, according to a first embodiment of the disclosure, an aerosol generation device 100 comprises a body 102 housing various components of the aerosol generation device 100. The body 102 can be any shape so long as it is sized to fit the components described in the aerosol generation device 100. The body 102 can be formed of any suitable material, or indeed layers of material.

A first end of the aerosol generation device 100 that is an end near to the closure arrangement 106, shown towards the top of FIG. 1, is described for convenience as the top or upper end of the aerosol generation device 100. A second end of the aerosol generation device 100 that is an end further from the closure arrangement 106, shown towards the bottom of FIG. 1, is described for convenience as a bottom, base or lower end of the aerosol generation device 100. Movement from the top of the aerosol generation device 100 to the bottom of the aerosol generation device 100 is described for convenience as down, while movement from the bottom of the aerosol generation device 100 to the top of the aerosol generation device 100 is described for convenience as up. During use, the user typically orients the aerosol generation device 100 with the first end downward and/or in a distal position with respect to the user's mouth and the second end upward and/or in a proximate position with respect to the user's mouth.

The aerosol generation device 100 comprises a heating chamber 108 located towards a first end of the aerosol generation device 100. At one end of the heating chamber 108, there is provided an aperture 104 through the body 102; the aperture 104 provides access to the heating chamber 108 from outside the body 102, so that an aerosol substrate (not shown) can be placed into the heating chamber 108 via the aperture 104.

At the aperture 104, where the heating chamber 108 is proximate to the body 102, one or more spacing elements, such as washers, are provided to mount the heating chamber 108 in position. The spacing elements reduce the conduction of heat from the heating chamber 108 to the body. There is typically an air gap otherwise surrounding the heating chamber 108, so that transfer of heat from the heating chamber 108 to the body 102 other than via the spacing elements is also reduced.

In order to increase the thermal isolation of the heating chamber 108 further, the heating chamber 108 is also surrounded by insulation (not shown). In some embodiments, the insulation is fibrous or foam material, such as wool. In some embodiments, the insulation comprises a pair of nested tubes or cups enclosing a cavity therebetween. The cavity can be filled with a thermally insulating material, for example fibres, foams, gels or gases (e.g. at low pressure) and/or the cavity may comprise a vacuum. Advantageously, a vacuum requires very little thickness to achieve high thermal insulation.

The aperture 104 is typically a circular aperture that is centred on an axis A-A. It will be appreciated that any shape of aperture may be used, e.g. a square or triangular aperture may be used, where the axis A-A passes through the centre of the aperture 104. The axis A-A can be considered as an axis perpendicular to a plane formed by the aperture 104—e.g. that plane on which the aperture 104 lies. More specifically, a 2D shape, typically a circle, can be formed from the perimeter of the aperture 104 as seen when looking towards the aperture 104. This 2D shape lies on a plane, which is a plane defined by the aperture 104.

The heating chamber 108 is typically formed by deep drawing. This is an effective method for forming the heating chamber 108 and can be used to provide a thin side wall. The deep drawing process involves pressing a sheet metal blank with a punch tool to force it into a shaped die. By using a series of progressively smaller punch tools and dies, a tubular structure is formed which has a base at one end and which has a tube that is deeper than the distance across the tube (it is the tube being relatively longer than it is wide which leads to the term "deep drawing"). Similarly, the base formed in this way is the same thickness as the initial sheet metal blank. A flange can be formed at the end of the tube by leaving a rim of the original sheet metal blank extending outwardly at the opposite end of the tubular wall to the base (i.e. starting with more material in the blank than is needed to form the tube and base). Alternatively, a flange can be formed afterwards in a separate step involving one or more of cutting, bending, rolling, swaging, etc. The heating chamber 108 being formed by deep drawing results in an aperture 104 that is formed during the deep drawing process.

The aerosol generation device 100 comprises a closure arrangement 106 arranged so as to be moveable between at least a closed position, in which the closure arrangement 106 obstructs the aperture 104 so that material cannot enter the heating chamber 108, and an open position, in which the aperture 104 is uncovered to allow access to the heating chamber 108. The closure arrangement 106 typically comprises a closure 107, the closure 107 being provided external to the body 102 of the aerosol generation device 100 and thereby being available for interaction with a user. The aerosol generation device 100 comprises a resilient element 114 arranged to deform as the closure arrangement 106 moves; and comprises a guide 122 along which a carriage 124 of the closure arrangement 106 is arranged to move.

The closure 107 is typically arranged to be moveable between the closed position and the open position by sliding relative to the body 102; as the closure 107 slides between the closed position and the open position the carriage 124 of the closure arrangement 106 moves along the guide 122. In some embodiments, the closure 107 is arranged to rotate between the closed position and the open position; in these embodiments, the rotation may be in any plane, e.g. the rotation may be in the plane formed by the aperture 104 or may be perpendicular or transverse to the plane formed by the aperture 104.

Typically, the resilient element 114 is a spring, such as a helical (or coil) spring or a torsion spring. In this embodiment, the resilient element is a helical compression spring. When the spring is deformed away from a relaxed position, the spring exerts a compressive force or an extensive force along an axis defined by a first end 112 of the resilient element 114 and a second end of the resilient element 114. The force exerted by the spring is dependent on the deformation, where the magnitude of the force exerted increases as the magnitude of the deformation from the relaxed position increases.

The resilient element 114 is mounted on a rigid element 116; the rigid element 116 is attached at a first end 118 (either directly or indirectly) to the carriage 124 and is attached at a second end 120 (either directly or indirectly) to the body 102 of the aerosol generation device 100; therefore, as the carriage 124 moves along the guide 122, the rigid element 116 rotates within the aerosol generation device 100 about the second end 120 and the resilient element 114 also rotates.

Typically, the resilient element 114 is mounted around the rigid element 116 so that, in the case where the resilient element 114 is a helical spring, the helical (or central) axis of the helical spring is aligned with the longitudinal axis of the rigid element 116.

The second end of the resilient element 114 is mounted on the rigid element 116 and thereby held in place relative to the aerosol generation device 100. The first end 112 of the resilient element 114 is mounted to a traveller (not shown in FIG. 1), the traveller being arranged to interact with the carriage 124. Specifically, the traveller is arranged to move longitudinally along the rigid element 116. The resilient element 114 is arranged to interact with the traveller as the traveller moves along the rigid element 116. Typically, the traveller is arranged to compress the resilient element 114 as it moves along the rigid element 116.

The first end 112 of the resilient element 114 is arranged to interact with the carriage 124 so as to move between a first position and a second position as the closure 107 moves between the open position and the closed position. The guide 122 is typically arranged so that, as the carriage 124 moves along the guide 122, the distance between the first end 112 and the second end of the resilient element 114 changes and so the resilient element 114 is deformed leading to the resilient element 114 exerting a force on the first end 112.

In some embodiments, this comprises the resilient element 114 being compressed as the closure 107 moves away from the closed position so that the resilient element 114 resists displacement of the closure 107 away from the closed position.

In some embodiments, this comprises the resilient element 114 being compressed as the closure 107 moves away from the open position so that the resilient element 114 resists displacement of the closure 107 away from the open position.

In some embodiments, the resilient element 114 is arranged so that the open position and the closed position are both "stable" positions; e.g. there is zero net force acting on the closure 107 when the closure 107 is at either of the open position or the closed position. In some embodiments, at each of the closed position and the open position the resilient element 114 is in a substantially relaxed position so that the resilient element 114 exerts no, or only a negligible, force on the first end 112 or the second end of the resilient element 114. Typically, the resilient element 114 is arranged so as to be in a deformed position when the closure is in either of the closed position or the open position; here the resilient element 114 exerts a force when the closure is in either of the closed position or the open position; the force exerted by the resilient element 114 is balanced by a force exerted by a wall of the guide 122. In other words, the open and closed positions are positions of stable equilibrium. In these embodiments, a threshold force is required to displace the closure 107 from either of the closed position and the open position. The resilient element 114 is typically arranged so that the threshold force is sufficient to prevent the closure 107 from moving away from either position due to incidental contact (e.g. shifting in the pocket of a user), but not so high as to be difficult to move between positions. Typical values of the threshold force required to move the closure away from either of the stable positions are in the range of 0.1N to 10N, e.g. 3N.

When the first end 112 of the resilient element 114 is at a position on the guide 122 that is not a stable position, there is a net force placed on the first end 112, so that the first end 112 of the resilient element 114 and the closure 107 are biased towards a stable position. The direction in which the first end 112 is biased depends on the relative position of the first end 112 and the second end so that when the first end 112 is to the "left" of the second end, the resilient element 114 exerts a force that acts to move the first end to the left; when the first end 112 is to the "right" of the second end, the resilient element 114 exerts a force that acts to move the first end 112 to the right. The resilient element 114 is arranged so that as the closure 107 is moved from the closed position to the open position the first end 112 moves relative to the second end and the direction of the force exerted by the resilient element 114 changes.

In embodiments where the closure 107 is bi-stable, the resilient element 114 is arranged so that the force exerted by the resilient element 114 acts to bias the closure 107 towards the closed position from a first range of positions between the closed position and the open position and to bias the closure 107 towards the open position from a second range of positions between the closed position and the open position. The first range of positions is closer to the closed position than the second range of positions is to the closed position. Similarly, the second range of positions is closer to the open position than the first range of positions is to the open position.

Typically, the resilient element 114 is arranged so that the first range of positions is substantially adjacent to the second range of positions. Therefore, at every position (or substantially every position) of the closure 107 between the closed position and the open position, the closure 107 is biased towards either the closed position or the open position. More specifically, there may be a position (or region) of unstable equilibrium located part between the first and second ranges of positions (for example part way between the open and closed positions) in the sense that the resilient element 114 exerts no net force on the closure 107 via the closure arrangement 106. This usually occurs at the portion of the travel where the resilient element 114 changes between biasing the closure 107 towards the open position and biasing the closure 107 towards the closed position. Regions of unstable equilibrium are those where small displacements in any direction drive the closure 107 away from the unstable equilibrium region. Typically, the resilient element 114 is arranged so that such regions of unstable equilibrium are as small as possible.

In embodiments where the closure 107 is only "unistable", that is stable in only one of the closed position and the open position, the resilient element 114 is arranged so that the force exerted by the resilient element 114 acts to bias the closure 107 towards the sole stable position for all positions of the closure 107.

The resilient element 114 is arranged so that at substantially each position of the closure 107 between the closed position and the open position, a component of the deformation of the resilient element 114, and a component of the force exerted by the resilient element 114 is in the direction of the movement of the closure 107. The resilient element 114 is arranged so that when the closure 107 is in a stable position, this component of the force resists movement away from the stable position. The resilient element 114 is further arranged so that a component of the deformation of the resilient element 114, and a component of the force exerted by the resilient element 114, is transverse to the direction of the movement of the closure 107; this component of the force acts to force the first end 112 of the resilient element 114 against a side of the guide 122. Typically, a component of the deformation of the resilient element 114, and a component of the force exerted by the resilient element 114 is in the direction towards and/or away from the body 102 relative to the closure 107, e.g. towards the top or bottom of the aerosol generation device 100. This force acts to keep the first end 112 of the resilient element 114 pressed against a side, typically the top side, of the guide 122 as the closure 107 is moved from the closed position to the open position. This results in a smooth sliding movement of the closure 107 that is pleasant for the user.

It will be appreciated that the aerosol generation device 100 may be held at any orientation. In general, a component of the deformation and/or force being described as "up" or "down" with reference to FIG. 1 may be considered to be a component of the deformation and/or the force being: in the direction of reception of material through the aperture 104, along an axis of the aperture 104, perpendicular or transverse to the plane defined by the aperture 104, perpendicular or transverse to a direction of movement of the closure 107, towards/away from the body 102 relative to the closure 107, and/or along the major axis of the aerosol generation device 100.

The first range of positions and the second range of positions are typically of comparable size, for example in some embodiments, the first range of positions is that where the first end 112 of the resilient element 114 is between the first position and the centre point of the guide 122 and the second range of positions is that where the first end 112 of the resilient element 114 is between the centre point of the guide 122 and the second position. In some embodiments, the first range of positions and the second range of positions are differently sized, for example the resilient element 114 may be arranged so that the second end of the resilient element 114 is nearer to one end of the guide 122, e.g. nearer the first position than the second position (e.g. almost "below" and slightly to the "right" of the first end of the guide 122), in this case the second range of positions is larger than the first range of positions and only a small movement away from the closed position is required before the resilient element 114 acts to bias the closure 107 towards the open position.

In some embodiments, the resilient element 114 is arranged so that the biasing force differs when the first end 112 is in the first position as compared to when the first end 112 is in the second position. Thus, the force required to move the closure 107 away from the closed position towards the open position differs from the force required to move the closure 107 away from the open position towards the closed position. This may be achieved by, for example, locating the second end of the resilient element closer to one end of the guide 122 than to the other end of the guide 122.

In some embodiments, the guide 122 is linear. Typically, the resilient element 114 is arranged so as to be compressed increasingly as the first end 112 moves away from the stable position and/or through the first range of positions and so, with a linear guide, the magnitude of the force exerted by the resilient element increases as the first end 112 moves through the first range of positions. In the first embodiment, the guide 122 is arc-shaped so that as the first end 112 of the resilient element 114 moves along the guide 122 through the first range of positions the rate of increase in the deformation of the resistant element 114 decreases (and hence the rate of increase of the magnitude of the exerted force decreases). This arc-shaped guide of the first embodiment thus results in an exerted force that increases slightly (but less than with a linear guide) during movement of the closure 107 away from the closed position through the first range of positions.

In some embodiments, the guide 122 is an arc arranged so that a force of constant magnitude is placed on the first end 112 of the resilient element 114 as it moves through the first range of positions and/or the second range of positions. More specifically, in some embodiments, the guide 122 is arranged so that the distance between the first end 112 and the second end of the resilient element 114 remains constant throughout the movement of the first end 112 along the guide; in these embodiments, the deformation of the resilient element 114 still changes as the first end 112 of the resilient element 114 moves since the direction of the deformation of the resilient element 114 changes. Thus, the direction of the force exerted on the first end 112 of the resilient element changes 114 (and the biasing direction changes).

In some embodiments, the guide 122 is arranged so that a decreasing force is placed on the first end 112 of the resilient element as it moves away from the stable position and/or through the first range of positions and/or through the second range of positions. This can be achieved, for example, by arranging the resilient element 114 and the guide 122 so that the resilient element 114 is compressed when the closure 107 is in the closed position and the magnitude of the compression of the resilient element 114 is reduced as the first end 112 is moved through the first range of positions.

As the first end 112 of the resilient element 114 moves along the guide 122, the direction of the force exerted by the resilient element 114 changes; at an equilibrium point there is no component of the force in either the direction of the closed position or in the direction of the open position, e.g. the force is in the "upwards" direction with no component to the "left" or "right". Before (to the closed side of) the equilibrium point, the biasing force exerted by the resilient element 114 acts to move the closure 107 towards the closed position. After (to the open side of) the equilibrium point, the biasing force exerted by the resilient element 114 acts to move the closure to the open position. It will be appreciated that the equilibrium point is a single point on the guide 122; in practice, it would be difficult to place the first end at the equilibrium point and so the first range of positions and the second range of positions are substantially adjacent. Further, in practice the inertia of the closure 107 as it is being moved between the open position and the closed position carries the first end 112 of the resilient element beyond the equilibrium position, so that it is typically unlikely that the closure 107 will come to rest stably between the closed position and the open position.

Figure 4:
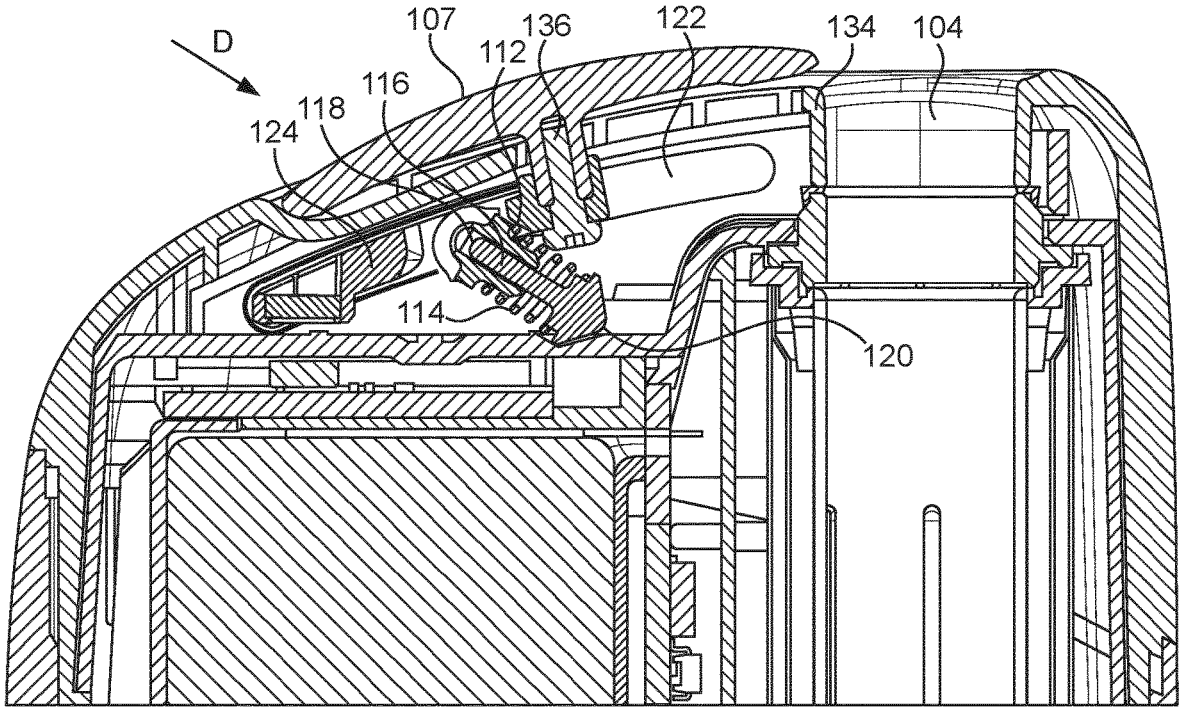
FIG. 4 is a schematic cross-sectional view from the side of a second embodiment of the closure, where the closure is in an activation position.

In some embodiments, such as the second embodiment shown in FIG. 4, the closure 107 is arranged to be further moveable from the open position to an activation position. Apart from having an activation position, the aerosol generation device 100 of the second embodiment is similar to the aerosol generation device of the first embodiment. In various embodiments, movement to the activation position from the open position includes movement: in the direction of the movement from the closed position to the open position, movement transverse to the direction of the movement from the closed position to the open position, and/or towards the body 102 relative to the closure 107.

In the first embodiment, the aerosol generation device 100 does not have an activation position; typically, in these embodiments the closure 107 is arranged to be moveable only between the open position and the closed position.

In the second embodiment, the resilient element 114 is arranged so as to be deformed when the closure 107 is moved from the open position to the activation position. Specifically, the resilient element 114 is arranged so that the closure 107 is biased away from the activation position towards the open position.

The resilient element 114 may be arranged so as to deform when the closure 107 is moved between the closed position and the open position and/or when the closure 107 is moved between the open position and the activation position.

Typically, the resilient element 114 is arranged so that movement from the open position to the activation position occurs at least partially in a different direction to movement from the closed position to the open position. In this way, the force required to move the first end 112 from the first position to the second position may differ from the force required to move the first end from the second position to a third position, the third position being the position of the first end 112 when the closure 107 is in the activation position. This typically comprises the movement from the first position to the second position being primarily transverse to the direction of deformation of the spring, e.g. from "left" to "right" and the movement from the second position to the third position having a substantial component in the direction of the deformation of the spring, e.g. from "top" to "bottom". Thus, the movement from the first position to the second position requires a force, e.g. a force provided by a user of the aerosol generation device 100, acting against a relatively small component of the force exerted by the resilient element 114, the majority of the force being resisted by a side of the guide 122 while the movement from the second position to the third position typically requires a force acting against a proportionally greater component of the force exerted by the resilient element 114. In some embodiments, as the first end 112 of the resilient element 114 moves from the first position to the second position, the resilient element 114 primarily rotates, as the first end 112 moves from the second position to the third position, the resilient element 114 primarily compresses.

In some embodiments, a second resilient element (not shown) is arranged so as to bias the closure towards the open position from the activation position. The second resilient element may have a different stiffness, or require a different deformation force, than the resilient element 114.

Typically, the activation position is a transitory position, where a continuous force, e.g. a force provided by a user of the aerosol generation device 100, is required to keep the closure 107 in the activation position. The biasing force of the resilient element 114, or the second resilient element, acts to return the closure 107 to the open position if the force is removed.

In some embodiments, the activation position is also a stable position, e.g. the closure 107 is not biased away from the activation position. In these embodiments, the resilient element 114 acts so as to bias the closure 107 towards the open position from a third range of positions between the open position and the activation position and to bias the closure 107 towards the activation position from a fourth range of positions between the open position and the activation position. The third range of positions is closer to the open position than the fourth range of positions and the fourth range of positions is closer to the activation position than the third range of positions. Typically, the fourth range of positions is substantially smaller than the third range of positions, for example the first end 112 of the resilient element 114 may be arranged to fit into a recess at the activation position and to be biased towards the open position from any location where it is not in the recess, e.g. the first end 112 may "click into" and "click out of" the activation position.

The aerosol generation device 100 further comprises a battery 110, which powers a heater that heats the heating chamber 108.

Figure 2A:
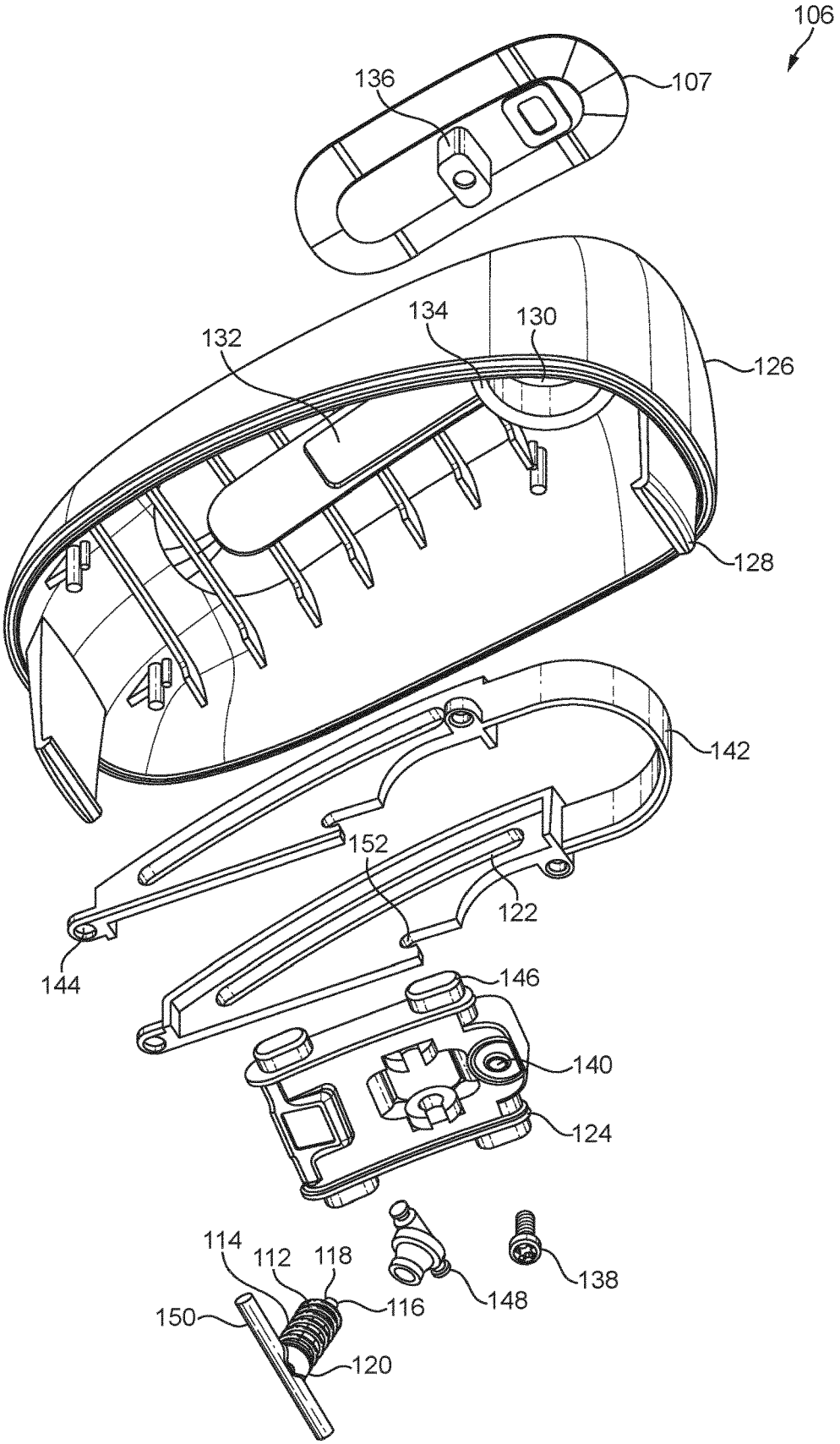
FIG. 2(*a*) is an exploded view of a closure of the first embodiment of the aerosol generation device.
Figure 2B:
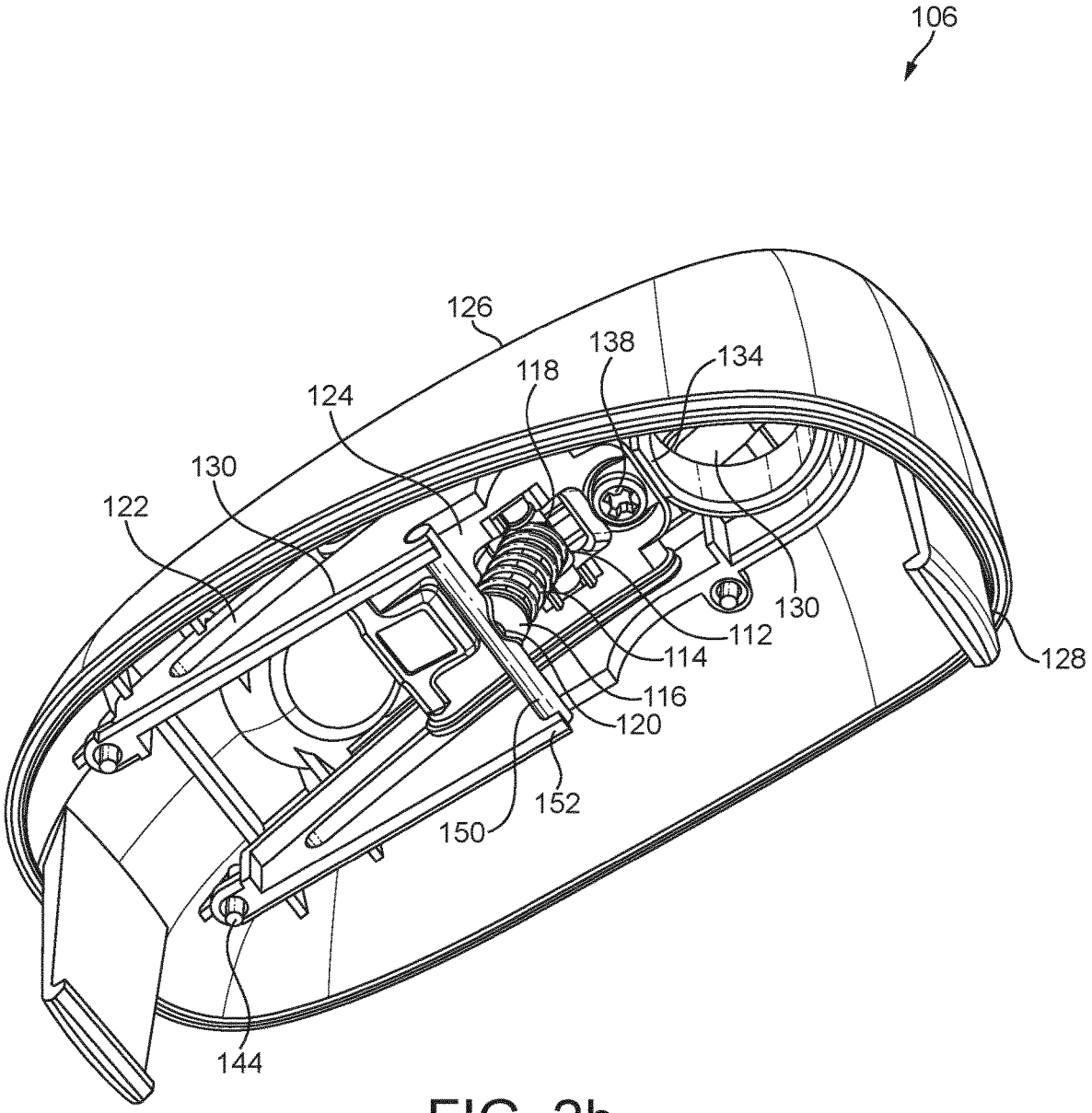

Referring to FIGS. 2*a* and 2*b*, there is shown a component view of the closure arrangement 106 of the first embodiment of the aerosol generation device 100.

A cover element 126 comprises a securing mechanism 128, a cover aperture 130 and a channel 132. The securing mechanism 128 is arranged to secure the cover element 126 and thereby the closure arrangement 106 to the body 102 of the aerosol generation device 100. The cover aperture 130 is arranged to enable access to the aperture 104 of the aerosol generation device 100 through the cover element 126. The channel 132 is arranged to allow components of the closure arrangement 106 to pass from the outside of the aerosol generation device 100 to the inside of the aerosol generation device 100.

The cover aperture 130 and the channel 132 are typically separated by a separator 134, which prevents items from moving between the channel 132 and the cover aperture 130. The separator 134 is typically a part of the edge of the cover aperture 130. In some embodiments, the separator 134 is an integral part of the material forming the aperture 104.

The closure arrangement 106 comprises the external closure 107 with which the user of the aerosol generation device can interact as well as a linking part 136 arranged to cooperate with the closure 107. The linking part 136 is sized, and arranged, to pass through the channel 132 of the cover aperture 130. By interacting with the closure 107, a user is able to interact with internal parts of the closure arrangement 106 via the linking part 136.

The closure 107 is arranged such that in the closed position it covers the cover aperture 130 and the aperture 104 thereby preventing the ingress of material into the heating chamber 108.

The closure 107 is arranged such that in the open position the cover aperture 130 and the aperture 104 are substantially uncovered thereby allowing the ingress of material into the heating chamber 108.

The linking part 136 is arranged to interact with the carriage 124 of the so that a movement of the closure 107 causes a movement of the carriage 124. Typically, the linking part 136 is attached to the carriage 124 using, for example using clips, screws, an adhesive, or another attachment means. In this embodiment, the attachment means comprises a screw 138 that passes through a hole 140 of the carriage 124 and fits into the linking part 136.

The guide 122 is located in a guide component 142 that is secured to the cover element 126 of the closure arrangement 106. The guide component 142 is secured to the body by a securing means that may, for example, comprise a snap fit, an adhesive, screws, pins, or other securing means. In this embodiment, the securing means comprises a plurality of screws 144.

The guide component 142 is arranged to be secured to the cover element 126 such that the sliding elements 146 of the carriage 124 are located in the guide 122 when the closure arrangement 106 is assembled.

The guide 122 typically comprises two guide sections, enclosed by material to the top and bottom of the guide sections, which extend along either side of the guide component 142. Between the two guide sections there is typically a cut-out. Therefore, the carriage 124 can be placed within the guide component 142 and between the two guide sections with the sliding elements 146 of the carriage 124 located in the guide sections.

The first end 112 of the resilient element 114 is arranged to interact with the carriage 124. Typically, the first end 112 of the resilient element 114 is mounted on the carriage 124 via a traveller 148. The traveller 148 is mounted to the carriage 124 with the first end 112 of the resilient element 114 arranged to interact with the traveller 148. Typically, the traveller 148 is arranged to move longitudinally along the rigid element 116; as the traveller 148 moves longitudinally along the rigid element 116, the first end 112 of the resilient element 114 also moves along the rigid element 116 and so the resilient element 114 is deformed. The traveller 148 typically comprises a hollow rod that is arranged to move along the outside of the rigid element 116. In some embodiments, the rigid element 116 is a hollow rod, and the traveller 148 is instead arranged to move inside the rigid element. The traveller 148 may also be deformable and may be arranged to compress or expand as it interacts with the rigid element 116.

In some embodiments, the traveller 148 comprises a limiting mechanism (not shown) that limits the extent to which the traveller 148 can move longitudinally along the rigid element 116; this may prevent the traveller 148 from separating from the rigid element 116 and/or may limit the extent to which the resilient element 114 can be deformed.

In some embodiments, the first end 112 of the resilient element 114 is attached to the traveller 148, in some embodiments the first end 112 of the resilient element 114 is free and is either compressed by the traveller 148 or extended by the force of the resilient element 114.

The second end of the resilient element 114 is mounted on a rotating bar 150; in some embodiments, the second end of the resilient element 114 is mounted to the second end 120 of the rigid element 116, the rigid element 116 being mounted on the rotating bar 150. Typically, the second end of the resilient element 114 and/or the rigid element 116 is held in place on the rotating bar 150 by a securing means, such as a clip or an adhesive. In some embodiments, the second end of the resilient element 114 is held in place by the force of the resilient element 114. The rotating bar 150 is mounted (directly or indirectly) to the body of the aerosol generation device 100; in this embodiment, the rotating bar 150 is mounted to the body 102 via the guide component 142 and to the guide component 142 via a snap fit attachment 152. It will be understood that the rotating bar 150 may be attached to the guide component 142 or any other component that is attached to the body 102 using another securing means, such as screws, clips, or an adhesive.

The rotating bar 150 is typically arranged to remain stationary relative to the aerosol generation device 100 as the carriage 124 moves along the guide 122. Hence, the resilient element 114 rotates as the carriage 124 moves along the guide 122, and as the closure 107 moves between the closed position and the open position.

To assemble the closure arrangement 106, the guide component 142 is attached to the cover element 126 using the attachment means 144. The sliding elements 146 of the carriage 124 are then placed into the guide 122 of the guide component 142. The resilient element 114 is placed around the rigid element 116 and the second end of the resilient element is mounted on the rotating bar 150. The traveller 148 is then placed onto the end of the rigid element 116 so that it can interact with the first end 112 of the resilient element 114. The rotating bar is then attached to the guide component 142 via the snap fit attachment 152 and the traveller 148 is attached to the carriage 124. The linking part 136 of the closure 107 is passed through the channel 132 of the cover element 126 and attached, on the internal side of the cover element 126, to the carriage 124. Finally, the closure arrangement 106 is attached to the body 102 of the aerosol generation device 100 by attaching the securing mechanism 128 of the closure arrangement 106 to the body 102. It will be appreciated that the order of the steps above is purely exemplary; these steps may be performed in any order.

Following assembly, a user of the aerosol generation device 100 can interact with the carriage 124, and hence the resilient element 114, by moving the closure 107.

Figure 3A:
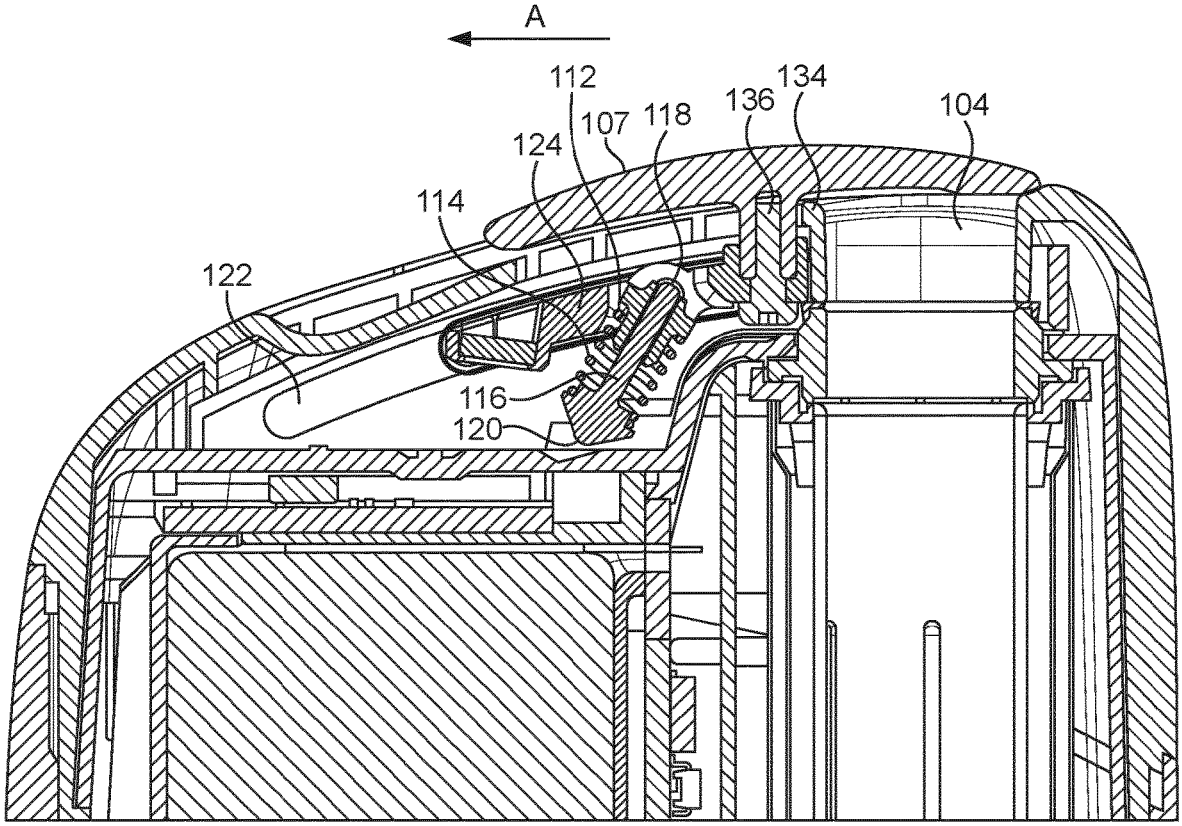
FIG. 3(*a*) is a schematic cross-sectional view from the side of the first embodiment of the closure, where the closure is in a closed position.
Figure 3B:
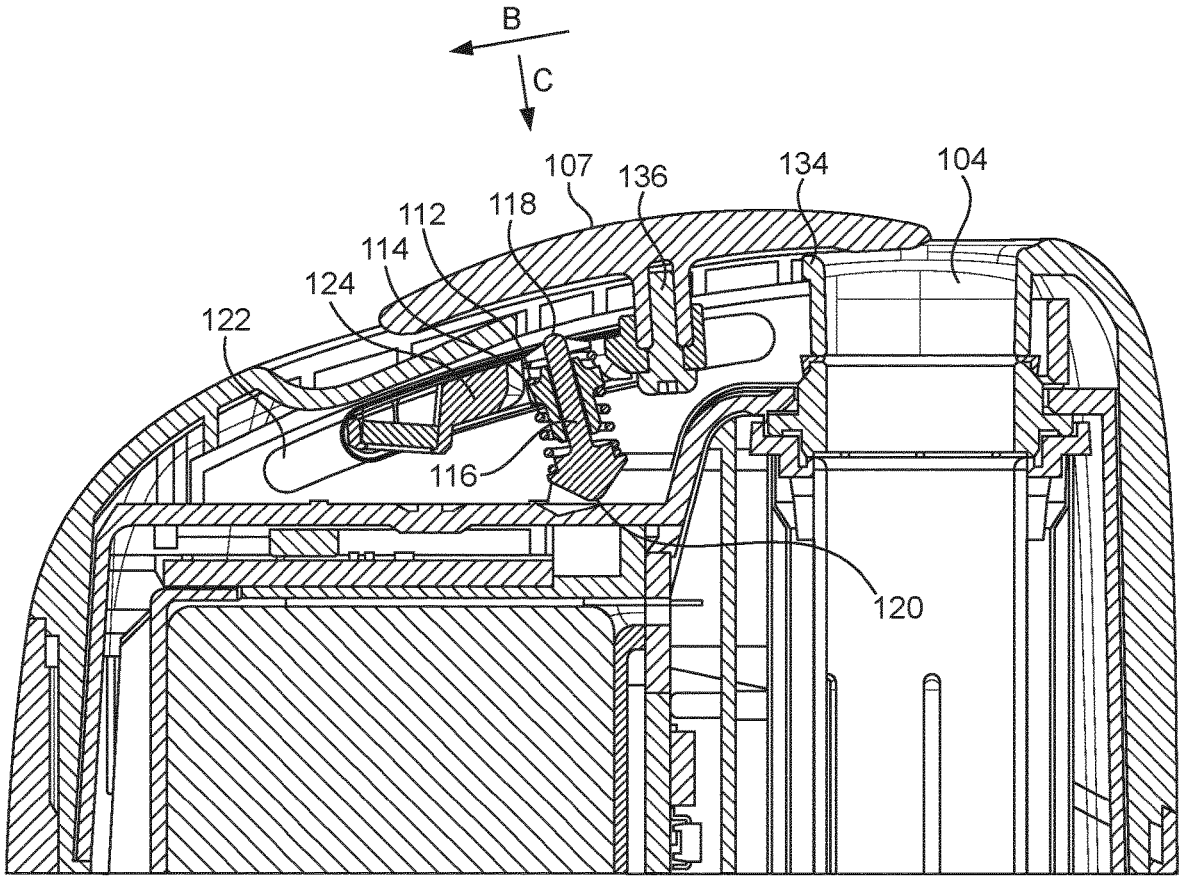
Figure 3C:
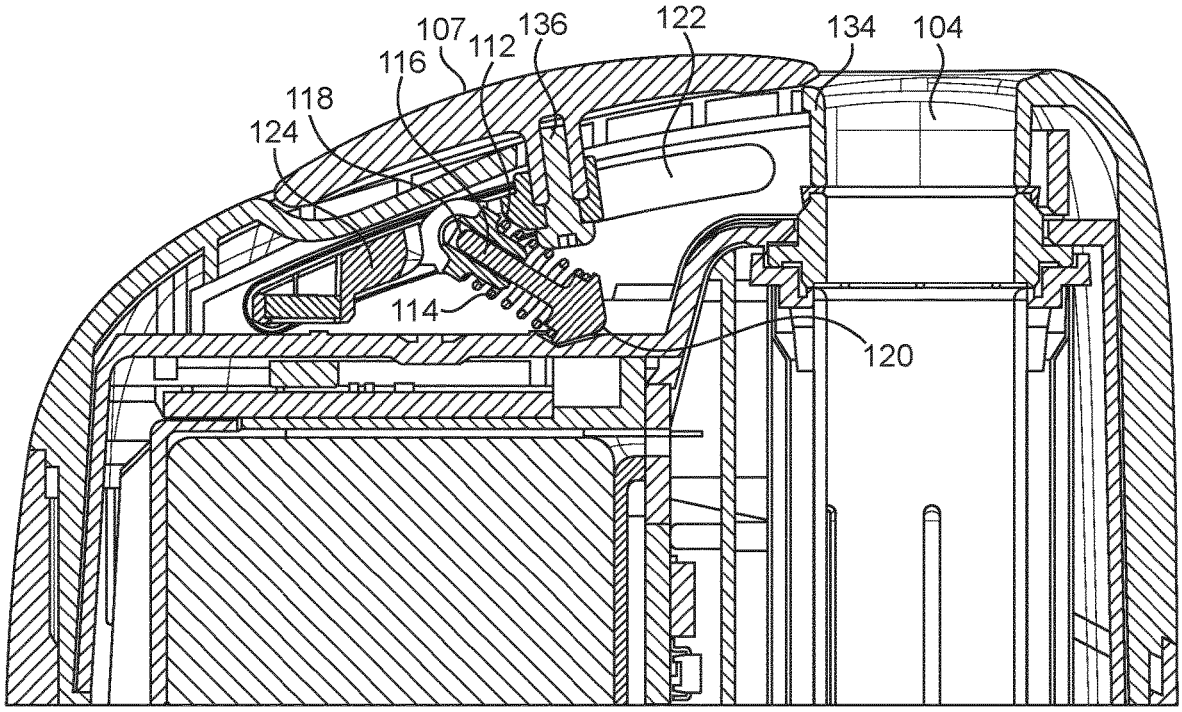

Referring to FIGS. 3*a* to 3*c*, the components of the closure arrangement 106 are shown when the closure 107 is in each of a closed position, an intermediate position, and an open position.

Referring to FIG. 3*a*, there is shown the closure 107 in the closed position. In this position, the closure 107 covers the aperture 104 of the aerosol generation device 100. The resilient element 114 is arranged so that when the closure 107 is in the closed position, the resilient element 114 resists movement of the closure 107 away from the closed position. In this embodiment, the resilient element 114 comprises a helical compression spring; as the first end 112 of the resilient element is 114 is moved away from the first position along the guide 122, the traveller 148 moves along the rigid element 116 and moves the first end 112 of the resilient element 114 towards the second end 120 of the resilient element 114. The resilient element 114 exerts a compressive force that acts in line with an axis that joins the first end 112 and the second end of the resilient element. A component of the compressive force acts to move the closure 107 to the closed position.

Specifically, as the carriage 124 moves along the guide 122, the distance between the carriage 124 and the second end of the resilient element 114 changes; this results in the carriage 124 applying a force on the traveller 148 that causes the traveller 148 to move along the rigid element 116 away from the first end 118 of the rigid element 116 towards the second end 120 of the rigid element 116. This carriage 124 interacts with the first end 112 of the resilient element 114 as it moves along the rigid element 116 resulting in the resilient element 114 being compressed. The compression of the resilient element 114 results in a force that acts on the carriage 124 via the traveller 148; on the linking part 136 via the carriage 124; and on the closure 107 via the linking part 136.

Further, the resilient element 114 rotates as the rigid element 116 rotates; so that the direction of the force exerted on the closure 107 by the resilient element 114 changes as the carriage 124 is moved along the guide 122.

In some embodiments, the guide 122 is arranged such that the distance between the carriage 124 and the second end of the resilient element 114 does not change as the closure 107 moves between the closed position and the open position; the force placed on the closure 107 still changes as the closure 107 moves due to the rotation of the rigid element 116 and the resultant rotation of the resilient element 114. In some of these embodiments, the traveller 148 is not used, and the first end 112 of the resilient element 114 attached directly to the carriage 124.

Referring to FIG. 3*b*, when the closure 107 is in the intermediate position the resilient element 114 exerts a force that acts to return the closure 107 to one of the open position or the closed position. The direction of the force depends on the position of the closure 107.

When the closure 107 is in between the closed position and the open position, the direction of the force placed on the first end 112 of the resilient element 114 depends on the location of the first end 112. Initially, as the closure 107 is moved away from the closed position the resilient element 114 acts to bias the closure 107 towards the closed position. As the closure 107 is moved further away from the closed position towards the open position, the first end 112 of the resilient element 114 moves away from the first position towards the second position; once the first end 112 of the resilient element 114 moves past the equilibrium point, the direction of the force placed on the first end 112 changes and the resilient element 114 acts to bias the closure 107 towards the open position.

Referring to FIG. 3*c*, in bi-stable embodiments when the closure 107 is in the open position, the resilient element 114 is arranged so as to resist movement of the closure 107 away from the open position in a way equivalent to that described with reference to the resistance of movement away from the closed position.

Referring to FIG. 4, in the second embodiment, the closure 107 is further moveable from the open position to reach an activation position. Typically, the closure 107 is arranged so as to be moveable towards the body 102 of the aerosol generation device 100 to reach the activation position; this results in the traveller 148 moving along the rigid element 116. In some embodiments, the traveller 148 is arranged to operate an activation sensor (not shown) once the traveller 148 reaches a certain point of the rigid element 116. The operation of the activation sensor initiates an activation signal, which, for example, is useable to initiate operation of the heater.

Referring to FIGS. 3*a* to 3*c*, the operation of the closure arrangement 106 by the user is described in more detail.

Typically, the aerosol generation device 100 starts in the closed position to prevent the ingress of undesired material into the heating chamber 108. When the user wishes to use the aerosol generation device 100, the user exerts a force on the closure 107 which acts to move the closure 107 towards the open position.

More specifically, the user applies an opening force on the closure 107 acting to move the closure 107 in an opening direction (A) in the direction of the open position from the closed position. The opening force is initially resisted by the resilient element 114, so that if the user releases the closure 107 before it has moved beyond the first range of positions, the closure 107 returns to the closed position.

As the user applies the opening force on the closure 107, the first end 112 of the resilient element 114 moves in a first direction (B) from the closed position towards the open position and eventually the first end 112 reaches the equilibrium point. Once the first end 112 of the resilient element 114 passes the equilibrium point, the force exerted by the resilient element 114 acts to move the closure 107 towards the open position.

As the first end 112 of the resilient element 114 moves in the first direction (B), the carriage 124 interacts with the traveller 148 to move the traveller 148 along the rigid element 116. As the traveller 148 moves along the rigid element 116, the resilient element 114 is deformed in a second direction (C). The second direction (C), and/or a component of the second direction (C) is transverse to the first direction (B), so that, for example, as the closure 107 moves horizontally from the closed position to the open position, the resilient element 114 is deformed vertically.

It will be appreciated that the second direction (C) may not be entirely transverse to the first direction (B), e.g. the second direction (C) may be transverse to a component of the first direction (B) and aligned with a component of the first direction (C).

Typically, as the closure 107 moves between the closed position and the open position, the first direction (B), that is the direction of movement of the first end 112 of the resilient element 114, is the same as the opening direction (A), that is the direction of movement of the closure 107. Once the closure 107 has reached the open position, the carriage 124 of the closure arrangement 106 is met by the end of the guide 122, which prevents further movement of the closure 107.

With the closure 107 in the open position, the user inserts an aerosol substrate (not shown) into the heating chamber 108 via the aperture 104. More specifically, a first end of the aerosol substrate is inserted in an insertion direction into the heating chamber 108 while a second end of the aerosol substrate remains external to the aerosol generation device 100 and is thereby accessible to the user.

Referring to FIG. 4, in the second embodiment, with the aerosol substrate located in the heating chamber 108, the user moves the closure 107 in an activation direction (D) towards the activation position. In this embodiment, the user moves the closure 107 towards the body 102 of the aerosol generation device 100. As the closure 107 moves towards the body 102, the traveller 148 moves along the rigid element 116 and operates the activation sensor. This operates an activation signal that (directly or indirectly) results in the operation of the heater. The heater heats the heating chamber 108 and thereby heats the aerosol substrate. The heating of the aerosol substrate produces a vapour, which the user is then able to inhale through the exposed end of the aerosol substrate. In embodiments without an activation position, the user typically operates another control means to activate the heater, such as pressing a button placed on the aerosol generation device 100.

The resilient element 114 typically acts to bias the first end 112 of the resilient element 114 and hence the traveller 148 away from the activation position towards the open position, so that the user is required to maintain pressure on the closure 107 in order to keep the closure 107 in the activation position.

Once the aerosol substrate has heated sufficiently, the user may remove pressure from the closure 107. Once the pressure is removed, the force exerted by the resilient element 114 acts to move the traveller 148 along the rigid element 116 away from the activation detector. This may send a deactivation signal, or cease the sending of the activation signal, to stop operation of the heater.

While inhaling the vapour, the user may repeatedly depress and release the closure 107 to move the closure 107 between the open position and the activation position so as to turn the heater on and off.

In embodiments without an activation position, the closure 107 moves between an open and a closed position, for example along a straight or curved path. Nevertheless, the resilient element 114 being biased in the manner described herein can provide a smooth and comfortable feeling for a user as they slide the closure 107. For example, the biasing provided by the resilient element 114 causes the carriage 124 to run along the guide 122, being biased towards the upper edge of the guide 122. It is common for the guide 122 to have a gap a little larger than the diameter of the sliding elements 146, in order that the motion of the carriage 124 is smooth and unobstructed. In such cases, the user will note that, due to the biasing of the resilient element 114, the closure 107 has a pleasing gliding feeling with a small degree of transverse motion possible by acting against the biasing force.

In some embodiments, the user may not need to hold the closure 107 in the activation position (or in examples where no activation position is present, may not need to hold the button down or continually trigger the other activation means) for the full heating cycle in order to activate the device 100. Instead, the device 100 may be configured to detect that the closure 107 has merely entered the activation position (or the button or other means has been triggered) or has been held there for a time period less than the time of a full heating cycle, and upon detection of this the full heating cycle will commence. This arrangement takes fine control out of a user's hands, and reduces the chance that an inexperienced user will hold the heater on for too long and overheat the aerosol substrate.

Referring to FIGS. 3*a* to 3*c*, when the user has exhausted the aerosol substrate, the user removes the aerosol substrate from the heating chamber 108 and disposes of the aerosol substrate. The user then applies a closing force on the closure 107 in the direction of the closed position from the open position. The closing force is initially resisted by the resilient element 114, so that if the user releases the closure 107 before the closure 107 has moved substantially, the closure 107 returns to the open position.

As the user continues to apply the closing force on the closure 107, the first end 112 of the resilient element 114 eventually reaches the equilibrium point. Once the first end 112 of the resilient element 114 passes the equilibrium point, the force exerted by the resilient element 114 acts to move the closure 107 towards the closed position. This process is broadly the reverse of the motions described above for moving the closure 107 from the closed position to the open position.

When the closure 107 is in the closed position, the aerosol generation device 100 can be stowed, for example in a bag or a pocket, and the closure 107 prevents the ingress of material into the heating chamber 108. The resilient element 114 biases the closure 107 towards the closed position to prevent the closure 107 from moving due to incidental contact with other objects.

Definitions and Alternative Embodiments

It will be appreciated from the description above that many features of the different embodiments are interchangeable with one another. The disclosure extends to further embodiments comprising features from different embodiments combined together in ways not specifically mentioned.

While the detailed description has primarily considered the use of a resilient element 114 that is compressed as the first end 112 of the resilient element 114 moves along the guide 122; it will be appreciated that the resilient element 114 may also be arranged to extend as the first end 112 of the resilient element 114 moves along the guide 122. In these embodiments, the extensive force is similarly arranged to bias the closure towards at least one of the open position and the closed position. Typically, the resilient element is still arranged to return the first end 112 towards the closed position from the first range of positions and toward the open position from the second range of positions so that the closure 107 remains stable in either the closed position or the open position. As opposed to a compressive arrangement, the use of an extensive arrangement typically leads to the first end of the resilient element 114 being forced towards a side of the guide 122 that is nearer to the body 102. While with a compressive arrangement the closure 107 is typically forced against the hand of the user moving the closure 107, with an extensive arrangement the closure 107 is typically forced away from the hand of the user moving the closure 107.

While the detailed description has primarily considered a bi-stable arrangement, where each of the open position and the closed position are stable positions, it will be appreciated that the resilient element 114 may also be arranged to bias the closure 107 towards a single position. Specifically, the resilient element 114 may be arranged such that at each position there is a component of force that acts to bias the closure 107 towards a certain position. As an example, the second end of the resilient element 114 may be fixedly placed to the 'left' of the carriage 124 of the closure arrangement 106 of the arrangement of FIG. 1; with this placement the resilient element 114 would exert a force that always acts to bias the carriage 124 and hence the closure 107 to the 'right', that is towards the closed position.

While the rigid element 116 and the traveller 148 have been described as being rods, it will be appreciated that these components may be of any shape that enables translational movement. In some embodiments, the traveller 148 is tapered and/or the rigid element 116 and the traveller 148 have an interference fit. In these embodiments, the resistive force of the interference fit typically acts to resist movement of the traveller 148 along the rigid element when the closure 107 is moved away from a stable position.

While the detailed description has primarily considered a rotating rigid element 116, the disclosure also relates to a rigid element that does not rotate. In embodiments where the rigid element 116 does not rotate, the traveller 148 moves interacts with the first end 112 of the resilient element 114 so as to move the first end 112 of the resilient element 114 directly towards or away from the second end of the resilient element 114. Typically, the guide 122 is a linear guide and the rigid element 116 is arranged so that the longitudinal axis of the rigid element 116 is aligned with the guide; in this way a movement of the carriage 124 along the guide 122 is either directly towards or directly away from both of the first end 112 and the second end of the resilient element 114. Typically, the resilient element 114 is placed beyond the open position relative to the closed position and the resilient element 114 is arranged so as to be compressed as the closure 107 moves from the closed position to the open position; this causes an increasing compressive force to be generated by the resilient element 114 that resists the opening of the closure 107. There may then be a recess or a retaining mechanism located on the closure so that the carriage 124 is held in place once the open position is reached.

While the detailed description has primarily described the rigid element 116 as rotating, it will be appreciated that the rigid element 116 may also move in other ways. For example, the second end 120 of the rigid element 116 may also translate relative to the body 102 as the first end 118 moves with the carriage 124. Typically, the translation of the rigid element 116 is limited. In the first embodiment, translation of the rigid element 116 relative to the body 102 is prevented as the rotating bar 150 is fixed in place; however, in some embodiments, the rotating bar 150 is arranged to move within a groove so as to allow translation of the second end 120 of the rigid element 116. In these translating embodiments, the rigid element 116 still rotates relative to the body, albeit not around a fixed point.

In some embodiments, the groove is used to bias the closure 107 towards each stable position through a greater distance. Specifically, the groove is arranged so that the second end 120 of the rigid element 116 is held at the 'left' end of the groove when the closure 107 is at the 'right' position; this causes the resilient element 114 to resist movement away from the right position. Typically, the left end of the groove is to the left of the centrepoint of the guide 122, so that the closure 107 is biased towards the right position for more than half of the distance of movement from the right to left position. Similarly, the groove is arranged so that when the closure 107 is at the 'left' position, the second end 120 of the rigid element 116 is at the 'right' end of the groove so that the resilient element 114 resists movement of the closure 107 away from the left position. Typically, the right end of the groove is to the right of the centrepoint of the guide 122, so that the closure 107 is biased towards the left position for more than half of the distance of movement from the left to right position. The second end 120 of the rigid element 116 moves from the left to right end of the groove when the first end 112 of the resilient element 114 moves from the right of the second end 120 to the left of the second end 120. The groove is arranged so that this occurs when the closure 107 has moved the majority of the way from the right position to the left position—similarly, the groove is arranged so the second end 120 moves from left to right when the closure 107 has moved the majority of the way from the right position to the left position. This enables the bias to be provided such that there are two stable positions and the bias resists movement away from the starting stable position for the majority of the distance of the movement of the closure 107.

While the detailed description has described the second end 120 of the rigid element 116 being fixed to the rotating bar, it will be appreciated that there are other ways in which the second end 120 could interact with the body 102 and it will be appreciated that the second end 120 is not necessarily fixed in place relative to the body 102. For example, in some embodiments, the second end 120 of the rigid element 116 is arranged to fit loosely within a recess in the guide component 142 so that the second end 120 rotates in this recess as the rigid element 116 rotates.

As used herein, the term "vapour" (or "vapor") means: (i) the form into which liquids are naturally converted by the action of a sufficient degree of heat; or (ii) particles of liquid/moisture that are suspended in the atmosphere and visible as clouds of steam/smoke; or (iii) a fluid that fills a space like a gas but, being below its critical temperature, can be liquefied by pressure alone.

Consistently with this definition the term "vaporise" (or "vaporize") means: (i) to change, or cause the change into vapour; and (ii) where the particles change physical state (i.e. from liquid or solid into the gaseous state).

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. An aerosol generation device comprising:

a body having an aperture through which an aerosol substrate is receivable into the aerosol generation device;

a closure moveable relative to the aperture between a closed position in which the closure covers the aperture and an open position in which the aperture is substantially unobstructed by the closure;

a rigid element having a first end arranged to cooperate with the closure and a second end pivotally coupled to the body such that the rigid element rotates relative to the body as the closure moves between the closed position and the open position;

a resilient element mounted on the rigid element, the resilient element being arranged to provide a resilient force that biases the closure towards at least one of the closed position and the open position; and a guide, wherein a carriage is arranged to move along the guide as the closure moves between the open position and the closed position, the carriage being arranged to interact with the closure.

2. The aerosol generation device according to claim 1, wherein the resilient element is arranged to be displaced with the closure in a first direction as the closure moves between the closed position and the open position, and wherein at least a first end of the resilient element is arranged to move in a second direction as the closure moves between the closed position and the open position, the second direction being transverse to the first direction.

3. The aerosol generation device according to claim 2, wherein the second direction is parallel to a length of the rigid element between the first end thereof and the second end thereof.

4. The aerosol generation device according to claim 2, wherein the second direction extends towards the body from the closure.

5. The aerosol generation device according to claim 1, the rigid element having a traveller arranged to move in a direction extending between the first end and the second end of the rigid element as the closure moves between the closed position and the open position, the traveller cooperating with the resilient element to transfer the resilient force between the resilient element and the closure.

6. The aerosol generation device according to claim 1, wherein the resilient element deforms in order to provide the resilient force, a direction of the deformation being guided by the rigid element.

7. The aerosol generation device according to claim 6, wherein the direction of the deformation is parallel to a length of the rigid element between the first end and the second end of the rigid element.

8. The aerosol generation device according to claim 1, wherein the resilient element is a helical compression spring.

9. The aerosol generation device of claim 8, wherein the rigid element comprises a shaft on which the helical compression spring is located.

10. The aerosol generation device of claim 1, wherein the resilient element is arranged to provide the resilient force so as to bias the carriage towards a side of the guide.

11. The aerosol generation device of claim 1, wherein the closure is stable in each of the closed position and the open position.

12. The aerosol generation device of claim 1, wherein the closure is further moveable from the open position to an activation position at which the aerosol generation device is operable to initiate an activation signal.

13. The aerosol generation device of claim 12, wherein the resilient element is arranged to provide the resilient force so as also to bias the closure away from the activation position.

14. The aerosol generation device of claim 1, wherein the resilient element is arranged so as to deform in at least one of: a direction out of a plane defined by the aperture; a direction aligned with an axis of the aperture; and/or a direction aligned with a direction in which the aerosol substrate is receivable when the closure is moved between the closed position and the open position.

15. The aerosol generation device of claim 1, wherein the guide provides an arc-shaped or linear guiding path.

16. The aerosol generation device of claim 10, wherein the side of the guide is away from the body.

17. The aerosol generation device of claim 11, wherein the resilient element is arranged so as to bias the closure towards the closed position from a first range of positions between the closed position and the open position and to bias the closure towards the open position from a second range of positions between the closed position and the open position, the first range of positions of the closure being closer to the closed position than the second range of positions and the second range of positions of the closure being closer to the open position than the first range of positions.

18. An aerosol generation device comprising:

a body having an aperture through which an aerosol substrate is receivable into the aerosol generation device;

a closure moveable relative to the aperture between a closed position in which the closure covers the aperture and an open position in which the aperture is substantially unobstructed by the closure;

a rigid element having a first end arranged to cooperate with the closure and a second end pivotally coupled to the body such that the rigid element rotates relative to the body as the closure moves between the closed position and the open position; and a resilient element mounted on the rigid element, the resilient element being arranged to provide a resilient force that biases the closure towards at least one of the closed position and the open position, wherein the resilient element is arranged to be displaced with the closure in a first direction as the closure moves between the closed position and the open position, and wherein at least a first end of the resilient element is arranged to move in a second direction as the closure moves between the closed position and the open position, the second direction being transverse to the first direction, and wherein the second direction extends towards the body from the closure.

* * * * *